United States Patent [19]

Ishii et al.

[11] Patent Number: 4,871,999

[45] Date of Patent: Oct. 3, 1989

[54] FIRE ALARM SYSTEM, SENSOR AND METHOD

[75] Inventors: Hiromitsu Ishii, Chiba; Takashi Ono, Yokohama, both of Japan

[73] Assignee: Hochiki Kabushiki Kaisha, Shinagawa, Japan

[21] Appl. No.: 51,576

[22] Filed: May 18, 1987

[30] Foreign Application Priority Data

May 19, 1986 [JP] Japan ..... 61-114223

[51] Int. Cl.[4] ..... G08B 17/00

[52] U.S. Cl. ..... 340/587; 340/628

[58] Field of Search ..... 340/587, 584, 511, 628–630; 356/439; 374/169, 172; 219/489

[56] References Cited

U.S. PATENT DOCUMENTS 4,280,052 7/1981 Solomon ..... 340/629 X 4,288,790 9/1981 Schnell ..... 340/628

4,582,982 4/1986 Piegari ..... 340/584 X

*Primary Examiner*—Glen R. Swann, III

*Assistant Examiner*—Thomas J. Mullen, Jr.

*Attorney, Agent, or Firm*—Max Fogiel

[57] ABSTRACT

A fire alarm system, sensor and method for determining a fire by detecting a change in a temperature, smoke density and/or gas concentration due to a fire. The detection data values of the respective analog sensors are corrected based on areas of supervisory regions of the respective analog sensors which are defined by walls, beams or inwardly extending projections surrounding the respective analog sensors, and/or heights from the floor of the respective analog sensors. The fire determination is carried out based on the corrected data.

21 Claims, 12 Drawing Sheets

FIRE ALARM SYSTEM, SENSOR AND METHOD

BACKGROUND OF THE INVENTION

1. Field of the Invention

This invention relates to a fire alarm system, sensor and method which is capable of detecting a fire through analog sensors of temperature, smoke density, etc.

2. Related Art

Convention fire alarm systems are, in general, of an on-off type and determine a fire based on whether the sensor detection data exceeds a threshold value set in a fire detector. In this type of fire alarm system, it has been a concern to eliminate possible false fire alarming and belated fire detection. For this reason, there has been proposed an analog information system. In the system, the temperature, smoke density, CO gas concentration, etc. which have been influenced by a fire are detected by using analog sensors; the detected analog data is transmitted to a central signal station where the determination as to whether there is a fire or not is made based on such a detected data change. For the same reason, so called intelligent type fire alarm sensors have also been proposed. The intelligent type sensor determines by itself if a fire is present.

In the conventional fire alarm system or sensor, data value output from the analog sensor may be influenced by diffusing behavior of smoke and CO gas and a rise in temperature surrounding the installed portion of the sensor which is changeable because of the installation height from a floor surface. For this reason, a fire alarm system able to obtain uniform results of fire alarm determination, even if the installation heights of the respective analog sensors differ from each other, has been proposed (Japanese Patent Gazette for Laying Open No.Showa 60(1985)-157695).

However, the difference of analog output data is caused not only by the difference of the installation heights but by the difference of configurations of rooms in which the analog sensors are installed. Judging from the knowledge of the inventors of the present invention, detection data output from the analog sensor will be influenced by the areas of the supervised regions of the respective analog sensors, which are defined by walls, beams or inwardly extending projections surrounding the respective analog sensors.

Inventors of the present invention found from the result of their experiments on varying areas of a laboratory room that there was a correlation between an installed area of an analog sensor and its detection data. This means that output values of the detection data may be different from each other even if they were detected under the same fire condition, and if the data were processed uniformly, there may be failure of early fire detection and also prevention of false fire alarms. For example, due to cigarette smoke in a small room, a conventional analog smoke sensor will detect high smoke concentration; a false fire detection will more easily occur in a small area room than in a large room. In a large room it needs longer time to detect fire than in a small room because smoke will be diluted by diffusion.

Inventors have considered that the above mentioned status might show a possibility of solution of such the false fire determination problem caused from difference of outputs of analog sensors by amending detection data or threshold values of analog sensors utilizing the above mentioned correlation.

Objects and Summary of the Invention

The present invention has been made the above problems and to realize highly reliable fire determination irrespective of differences in supervised areas and installation heights between the analog sensors.

A fire alarm system of the present invention may comprise a plurality of analog sensors for detecting a change in ambient conditions caused by a fire; a correcting means for providing correct data from the respective analog sensors on the basis of set areas of supervised regions which are defined by walls, beams, or inwardly extending projections surrounding the respective analog sensors; and a fire determining means based on the correction data provided by said correcting means.

According to this feature of the invention, since the detection data is corrected based on the areas of the supervised regions, fire determination can be effected within the same time even if the areas of the supervisory regions for the respective analog sensors differ from each other. This enables prevention of false fire determination; for example, due to cigarette smoke in a small room. This also enables the same early fire determination in a large room as in a small room.

The correcting means may provide the correction data according to the supervised areas and to an installation height of the respective analog sensors from a floor surface.

According to this example, substantially uniform detection data can be obtained irrespective of differences in supervised areas and installation heights between the analog sensors. Therefore, possible false alarms can be prevented and early fire detection can be realized.

The correcting means may also provide threshold values of the respective analog sensors based on the set areas of the correction data.

According to this feature of the invention, since the threshold values for fire determination are corrected on the basis of the supervised areas, prevention of possible false fire alarms and early fire determination can be attained even if the detection data. are varied due to the differences in the areas.

A fire alarm sensor of the present invention may comprise an analog sensor section for detecting a change in ambient conditions caused by a fire; a correcting section providing correct data from the respective analog sensors on the basis of set areas of supervised regions for which are defined by walls, beams, or inwardly extending projections surrounding the respective analog sensors; and a fire determining section based on the correction data provided by said correcting section.

A fire alarm method of the present invention may comprise a correcting step for providing correct data from the respective analog sensors on the basis of set areas of supervised regions which are defined by walls, beams, or inwardly extending projections surrounding the respective analog sensors; and a fire determining step based on the correction data provided by said correcting step.

The fire alarm sensor and method may have examples similar to those of the above mentioned fire alarm system of the present invention, and similar technical effects can be obtained.

BRIEF DESCRIPTION OF THE DRAWING

FIG. 2 is a perspective view showing the diffusing behavior of smoke within a room at an early stage of a fire;

FIG. 3 is a central sectional view taken along line III —III of FIG. 2;

FIG. 4 is a diagram showing a distribution of smoke density;

FIG. 5 is a graph showing smoke densities changed with time under the same fire conditions, (for example, when cotton smolders) but in rooms of different sizes;

FIG. 6 is a graph showing relative values of sensor outputs obtained through fire experiments conducted with room spaced changed in five sizes;

PREFERRED EMBODIMENT OF THE INVENTION

Figure 1:
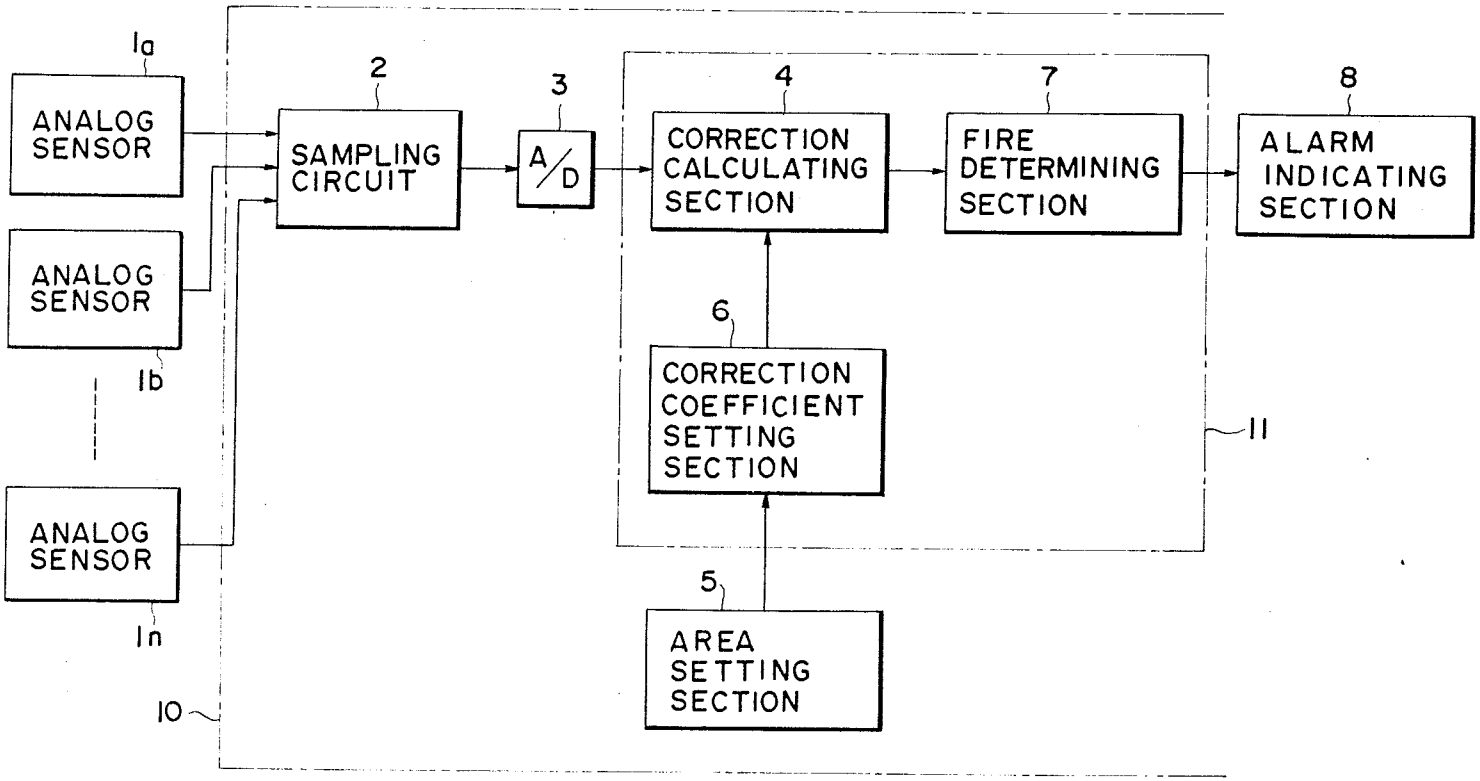
FIG. 1 is a block diagram of one configuration of a fire alarm system embodying the present invention.

FIG. 1 is a block diagram showing one embodiment of the present invention. The configuration of the embodiment will first be described. 1*a*, 1*b*,. . . 1*n* each designate an analog sensor, which may comprise a smoke density sensor, a temperature sensor, a CO gas sensor, etc. The sensors 1*a* to 1*n* are generally installed on a ceiling surface of a room to output an analog signal corresponding to a smoke density, a temperature, a CO gas concentration, etc. within the room.

Each of the analog sensors is connected to a central signal station 10 through a signal line. The central signal station 10 comprises a microcomputer 11 and terminal equipments such as input/output devices.

A sampling circuit 2 sequentially samples the analog detection signals output from the analog sensors 1*a* to 1*n* to generate output. An A/D converter 3 converts the analog detection signals sequentially obtained from the sampling circuit 2 to digital signals (hereupon, referred to as "sensor data").

A correction calculation section 4 multiplies the sensor data obtained from the A/D converter 3 by correction coefficients Ks, (predetermined according to the respective spaces or areas of regions for which the respective sensors 1*a* to 1*n* exercises supervision) to correct the sensor data. The correction coefficients KS used in the correction calculating section are set by a correction coefficient setting section 6. The correction coefficient setting section 6 sets, in the correction calculating section 4, the correction coefficients Ks selected, based on the areas of the respective analog sensors 1*a* to 1*n*, which are preliminarily set in an area setting section 5.

A fire determining section 7 receives the sensor data after correction to conduct fire determination processing. For this processing, functional approximations based on the plural corrected sensor data, which are continuous in time, are used. More specifically, the processing may be a predictively calculating process a time required for reaching a danger level, predetermined on the basis, for example, of a quadratic function, is predicted, and a fire determination is made when the predicted time is less than a predetermined time. The corrected sensor data is further compared with a predetermined threshold value to carry out fire determination processing, in which a fire is determined when the data exceeds the threshold value.

An alarm indicator 8 gives a fire alarm, such as sounding an alarm bell or lighting a fire-indicative lamp, in response to a fire determination output from the fire determinating section 7.

It will now be described why the correction calculating section 4 of FIG. 1 should correct based on the areas of the supervised regions.

Figure 2:
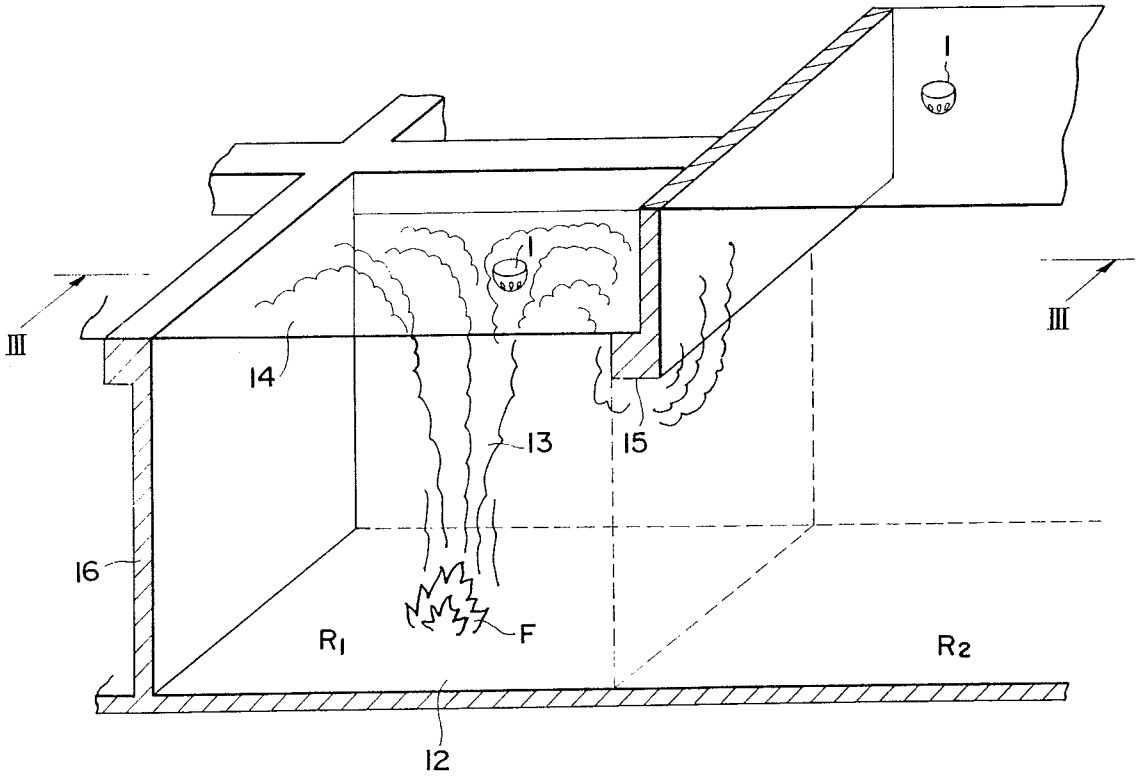
FIGS. 2 to 6 is explanatory view for showing the necessity of correction processing of data from sensors in the present system.
Figure 3:
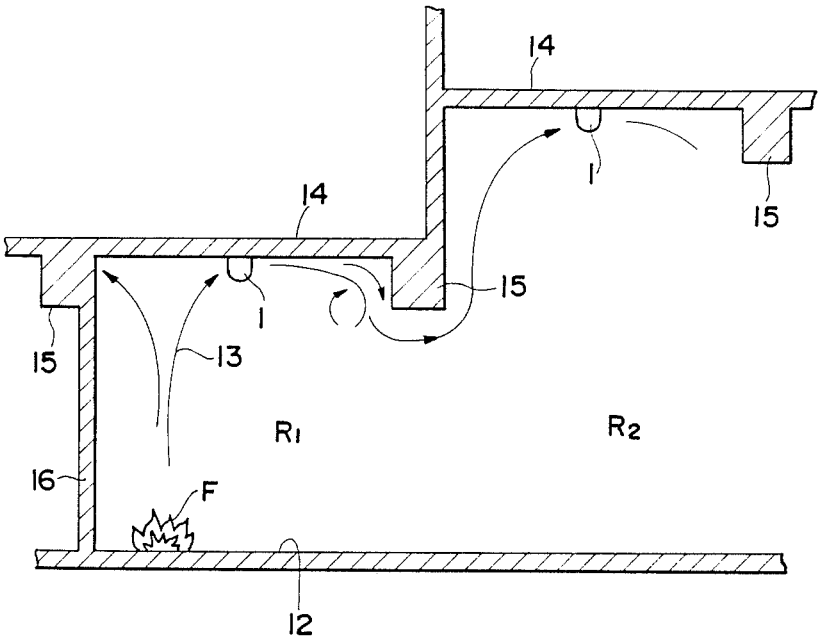
Figure 4:
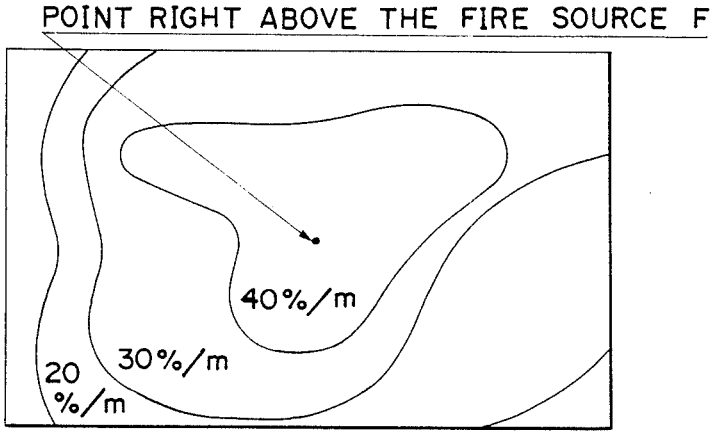

As illustrated in FIG. 2 and in FIG. 3, smoke 13 arising from a smoldering fire source F started on a floor 12 of a room R1 is conveyed by a hot air current which has been caused by the fire source F at an early stage of combustion. The the smoke is spread in all directions along a ceiling surface 14. The current of the spreading smoke 13 is obstructed by a beam 15 projected inwardly or a wall 16 and thus stays there for a while. At a moment under these conditions, the smoke density on the ceiling surface shows a distribution as illustrated in FIG. 4. FIG. 4 shows the results of the smoke density investigation conducted by the inventors, and the smoke density shown is much higher than the smoke density subjected to an ordinary smoke detection.

The smoke staying in the vicinity of the beam 15 flows over the beam, as the amount of the staying smoke increases, and enters the next room R2 or another adjacent room. More specifically, the smoke arising from the fire source F is not rather spreads all over the room from the start, but spread along the ceiling at the early stage of the fire. Then the smoke flows into an adjacent open space. The smoke does not permeate until the amount increases. In this connection, it is to be noted that the above-mentioned behavior of the smoke 13 is observed under the conditions of the rooms R1 and R2 as illustrated in FIG. 2; namely, three directions or sides are surrounded by beams 15 and only one direction or side (left side in FIG. 2) is closed by the wall 16, with the rooms R1 and R2 with each other in the directions or sides surrounded by the beam 15. In the case of a room which is enclosed by walls on all sides, the permeation of the smoke into the room begins immediately after spreading along the ceiling and obstruction by the walls.

Figure 5:
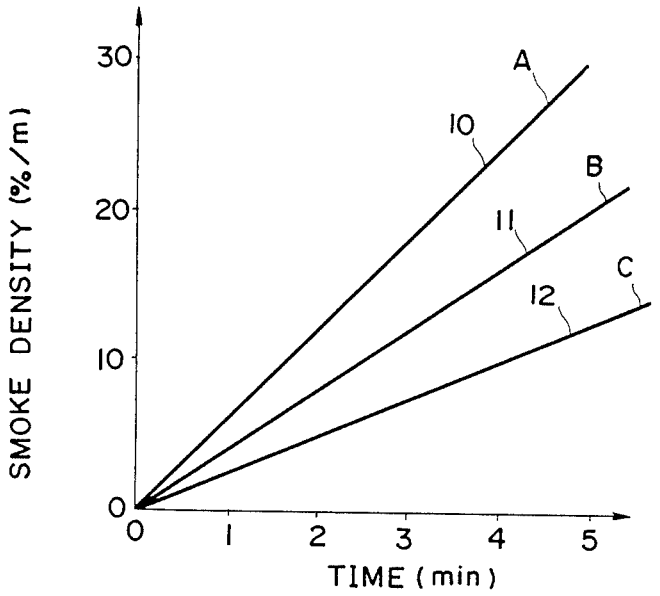

On the other hand, as the results of the experiments conducted by the inventors show that the smoke density change within the room is as follows:

FIG. 5 shows a change in the smoke density with time under the same fire conditions, for example, when cotton is smoldering, in different room areas. In FIG. 5, the smoke increase over time is substantially linear. A line A indicates a change over time in a narrow rom and lines B and C indicate changes over time in larger rooms.

As is apparent from the experimental data, the narrower the room, the larger change over time of the smoke density and the broader the room, the smaller the change over time of smoke density. Thus, the correction of the sensor data must correspond to the area of the room, the supervisory region of the analog sensor.

A fire should be detected at an early stage, namely, before the smoke passes over the beam 15 and flows into the next room. Therefore, the word "room", which each of the analog sensors supervises, should include a space surrounded by beams or other projections as illustrated in FIGS. 2 and 3 as well as an ordinary room which is enclosed by walls in all directions. The word "room" is used throughout the specification to mean not only the ordinary room but also the space as specified above.

For earlier detection of fire, at least one analog sensor is provided in each of the "rooms". However, another analog sensor or sensors differing in sensing subjects may be provided in combination with the above-mentioned one analog sensor to prevent possible misoperation due to smoke from cigarettes, for example.

Figure 6:
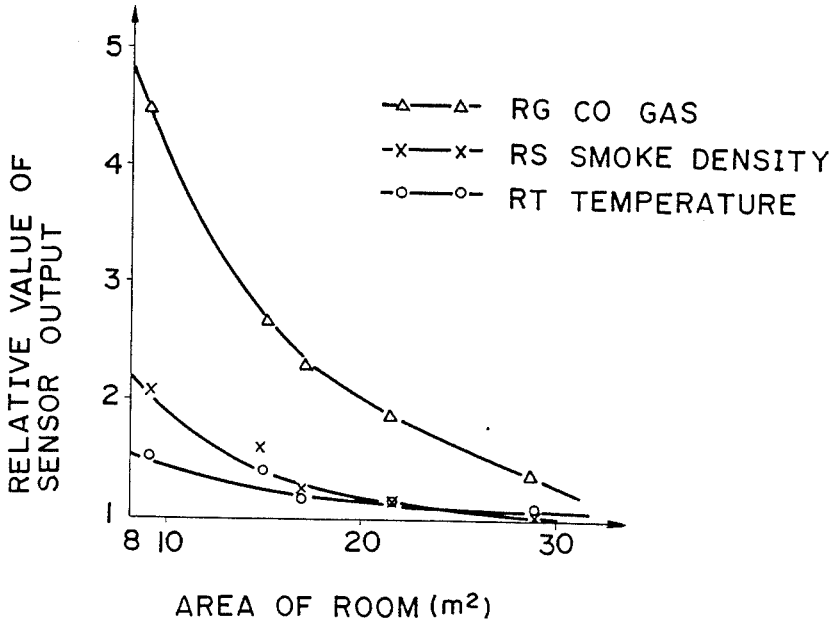

FIG. 6 is a graph showing characteristic curves of relative values of sensor outputs, which are obtained by conducting fire experiments while changing the room areas in five ways. In these experiments, the installation height of the analog sensor is fixed at 2.5 m, with a span defined by beams changed to vary the room area in five ways from 4.3 m $\times$6.7 m to 2.58 m $\times$3.48 m.

FIG. 6 shows the relative values of the sensor outputs in relation to the room areas, the smoke density, temperature, and CO gas concentration, respectively. The words "relative values of the sensor outputs" is used here to mean a ratio of the two sensor output values under some smoke density condition, or some temperature condition, or some CO gas concentration condition and a parameter room are that is varied. These temperature, smoke density and CO gas concentrations are apt to be concentrated to a certain value as the room area is increased. The concentrated certain value of the relative values of the sensor outputs are obtained when assuming the room is infinite as a reference and the its value is set to 1.

The characteristic curves, shown in FIG. 6, are approximation curves obtained by the method of least squares the of the sensor data at respective measuring points. Each of the characteristic curves may be expressed as follows:

$$RT = 1.0 \exp(-0.08S) + 1 \quad (1)$$

$$RS = 4.2 \exp(-0.15S) + 1 \quad (2)$$

-continued $$RG = 9.6 \exp(-0.11S) + 1 \quad (3)$$

where S represents an area ($m^2$) of the room and RT is temperature, RS is smoke and RG is gas.

If the detection data obtained from each of the analog sensors is multiplied by the inverse numbers of the relative values RT, RS and RG obtained by formulae (1) to (3) above, as correction coefficients KS, the same fire determining processing can be applied, irrespective of the kinds of the analog sensors and the areas of the rooms.

The correction coefficient setting section 6 sets the inverse numbers of the relative values RT, RS, and RG of the outputs obtained according to the formulae (1) to (3), as correction coefficients Ks, on the basis of the area of the room which has been obtained from the area setting section 5. Instead of calculating the formulae (1) to (3), the relative values RT, RS, and RG, with respect to the area S of the room, may be preliminarily calculated according to the formulae (1) to (3) to obtain correction coefficients KS in the form of inverse numbers of the relative values, and a collation table of the correction coefficients and the areas S of the room may be stored in memory. In this case, if the condition of the room is set, a corresponding correction coefficient can be determined definitely.

Figure 7:
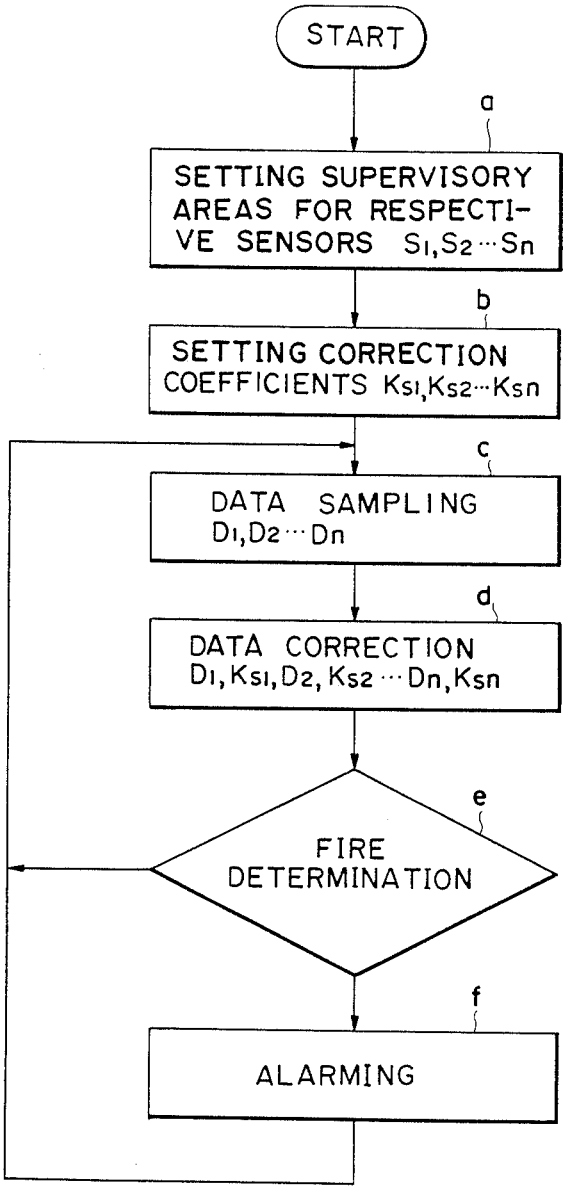
FIG. 7 is a flow chart showing an operation of the system illustrated in FIG. 1.

An operation of the embodiment of FIG. 1 will now be described referring to FIG. 7.

Areas S1, S2 ... Sn of rooms, which analog sensors 1a to 1n supervise, respectively, are set at block a. After the setting of the areas S1 to Sn of the rooms have been completed at block a, the step proceeds to block b to set correction coefficients KS1 to KSn corresponding to the respective areas S1 to Sn of the rooms. More specifically, the areas S1 to Sn of the room a set are put in formulae (1) to (3) corresponding to the temperature, smoke density and CO gas concentration to be detected by the respective analog sensors 1*a* to 1*n*, to obtain relative values RT, RS, and RG, and inverse numbers of the relative values are set as correction coefficients KS1 to KSn.

After the setting of the correction coefficients KS1 to KSn is complete at succeeding block c, analog detection data obtained from the respective analog sensors 1*a* to 1*n* are sampled sequentially at predetermined periods, and the data is converted into digital data by an A/D converter 3 to be supplied to a correction calculating section 4. The correction calculating section 4 multiplies the sensor data by the corresponding correction coefficients set at block b, as indicated at block d.

More specifically, if the actual detection data value is assumed as D, a correction value $DA = D\sqrt{KS}$ is obtained by multiplying a correction coefficient KS obtained from the formulae (1) to (3) above.

Subsequently, at determination block d fire determination occurs through predictory calculation by functional approximation, using the corrected sensor data or a comparison with a predetermined threshold value. If a fire is detected then the step proceeds to block f to give a fire alarm.

The inventors have discussed a target value (danger level) to be used for the predictory fire determination by the quadratic functional approximately. As a result of the inventor's fire experiments, conducted in a room having an area, for example, of 25 to 30 $m^2$, a temperature level at which a fire can be determined without delay and also discriminated from non-fire has turned to be 108° C. Thus, it has been proved that target values for fire determination by the quadratic functional approximation, with respect to a room of a general space, are preferably set at 120° C. +10° C. for temperature, 22.5%/m +2.5%/m or 700 ppm +50 ppm for CO gas concentration.

In the fire determination according to the present invention, the following determining times, from the start of a fire to the completion of the fire determination, are obtained through the fire experiments.

| Fire Determining Time (Time from Smoke or Combustion Starting) | | |
|---|---|---|
| | Area 9 $m^2$ | Area 30 $m^2$ |
| Temperature | 1' 03" | 1' 30" |
| Gas | 3' 22" | 4' 54" |
| Smoke | 1' 42" | 1' 54" |

The table shows the fire determining times for areas of rooms that are 9 $m^2$ and 30 $m^2$, respectively. The fire determining times for gas and smoke indicate the time from the start of smoke to completion of fire determination; the fire determining time for a temperature indicates time from the start of combustion to the completion of fire determination.

It is apparent from the fire determining times indicated in the table, that fire determination, based on the corrected sensor data according to the present invention, can be made within substantially the same time as the fire starting (smoke starting or combustion starting), irrespective of the areas of the rooms. This shows that the fire alarm system according to the present invention can provide a desired effect.

Figure 8:
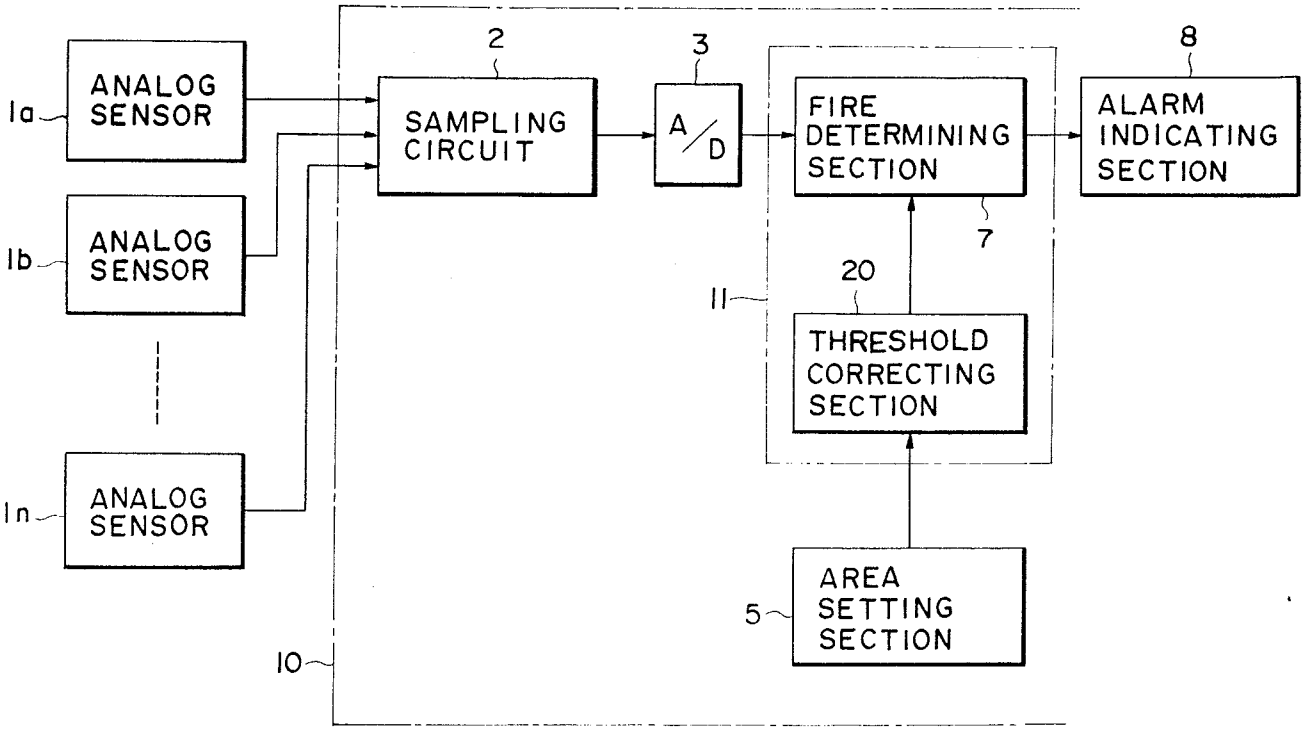
FIG. 8 is a block diagram of a second embodiment of the present invention.

FIG. 8 illustrates another embodiment of the present invention. In this embodiment, the threshold value to be employed in the fire determining circuit is corrected so as to correspond to the area of the room.

More particularly, a threshold value correcting section 20 is provided, instead of the correction calculating section 7 and the correction coefficient setting section 6 of the embodiment as shown in FIG. 1, for providing a threshold value for the fire determining section 4. This threshold correcting section 20 corrects reference thresholds preliminarily set for the respective analog sensors 1*a* to 1*n*, based on the areas S of the rooms, which are set by the area setting section 5. The remaining portion of the circuit configuration is substantially the same as that of FIG. 1.

A threshold value correcting operation at the threshold value correcting section 20 will now be described. First, a threshold value to be corrected is set in the threshold value correcting section 20. A smoke density of 10%/m, which is obtained as a concentrated value when the space of the room is enlarged infinitely in the characteristic curve of FIG. 6, is set as the reference threshold value.

The threshold value correcting section 20 calculates the relative values RT, RS and RG from the formulae (1) to (3) (after the area S of the room, which the sensor supervises, has been set at the area setting section 5) to obtain a corrected threshold value as given by:

(Corrected threshold) = (Reference threshold) ×

(Relative value)

The obtained corrected threshold value is set at a fire determining section 7.

The contents of the fire determination are substantially the same as those of the foregoing embodiment and will not be repeated here.

In another preferred embodiment of the present invention, correction is made for the sensor data, based on the installation height of the analog sensor as well as the area of the room, so a to attain more accurate fire determination free from the influences of the space of the room and the height of the sensor installation.

Figure 9:
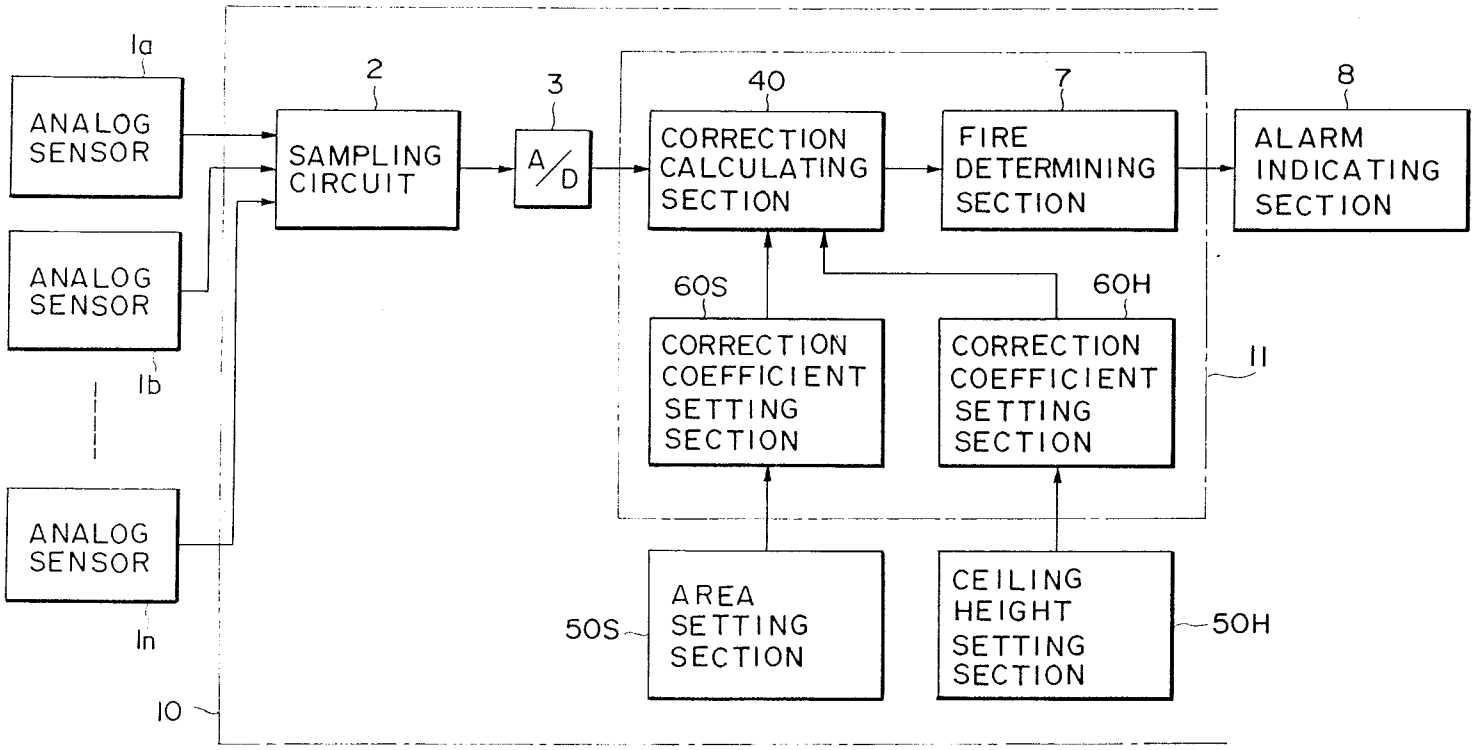
FIG. 9 is a block diagram of a third embodiment of the present invention.

FIG. 9 is a block diagram of this embodiment. In FIG. 9, 1*a* to 1*n* are analog sensors, 2 is a sampling circuit, 3 is an A/D converter, 40 is a correction calculating section, 7 is a fire determining section and 8 is an alarm indicating section.

The correction calculating section 40 multiplies the sensor data obtained from the A/D converter 3 by a correction coefficient KS, preliminarily set to to correspond with the area of the region which each of the analog sensors 1a to 1n supervises, and a correction coefficient KH preliminarily determined and corresponding to the installation height of the respective analog sensor 1*a* to 1*n* to correct the sensor data. The correction coefficients KS and KH, provided for the correction calculating section 40, are set by a first correction coefficient setting section 60S and a second correction coefficient setting section 60H.

The first correction coefficient setting section 60S sets a predetermined correction coefficient, based on the area of the room for the respective analog sensor 1*a* to 1*n*, which is preliminarily set at an area setting section 50s, in the correction calculating section 40. The contents of the correction, based on the area of the room, are identical with those of the foregoing embodiment.

The correction for the sensor data, based on the installation height by the correction calculating section 40, is carried out on the basis of the interrelation between the height and the sensor outputs, which are experimentally obtained. The graphs of FIGS.10 and 11 show a change in the sensor detection outputs when the height of a ceiling on which the analog sensor is installed.

Figure 10:
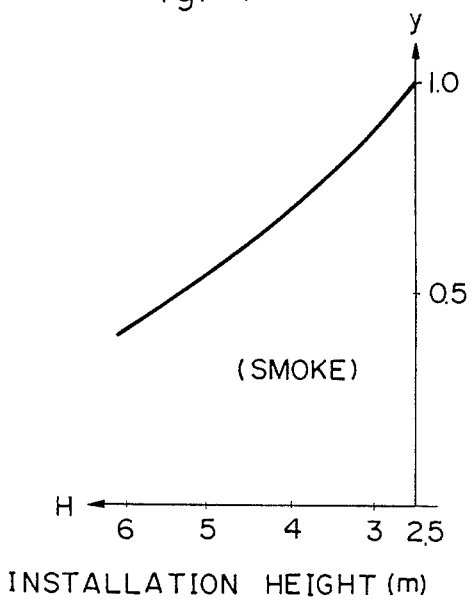
FIG. 10 is a graph showing a change in relative values of detection levels experimentally obtained by changing the installing height of a smoke sensor, in relation with an output level of the sensor which is assumed to be 1.0 when the smoke sensor is installed at a height of 2.5 m, directly above a fire source F.
Figure 11:
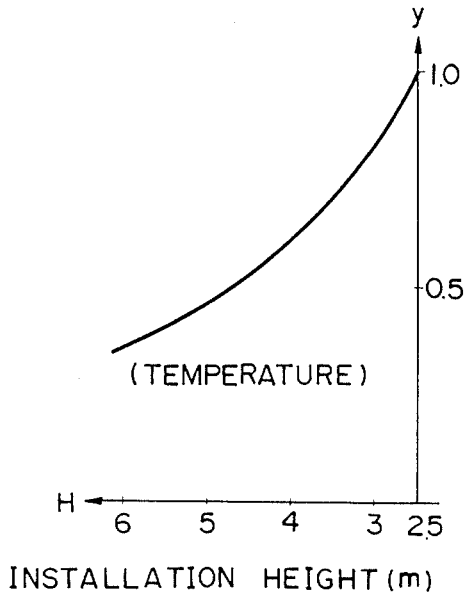
FIG. 11 is a graph showing a change in relative values of detection levels experimentally obtained by changing the installing height of a temperature sensor, in relation with an output level of the sensor which is assumed to be 1.0 when the temperature sensor is installed at a height of 2.5 m, directly above the fire source F.

FIG. 10 shows a change in the relative value of the detection level when the installation height of a smoke sensor is changed, with respect to the output level of 1 under the conditions that the smoke sensor is installed at a height of 2.5 m directly above a fire source F. On the other hand, FIG. 11 shows a change in the relative value of the detection level, when the installation height of a smoke sensor is changed, with respect to the output level of 1 under the conditions that the thermo-sensor is installed at a height of 2.5 m directly above a fire source F. If it is assumed that the relative value is y and the height of the ceiling surface is H, then it has been experimentally proved there is the following relation in either of FIG. 10 and FIG. 11:

$$y = \alpha \cdot exp\{-\beta(H-Ho)\} \quad (4)$$

where a is a coefficient for correcting fluctuation in the sensor outputs, $\beta$ is an index determined from the sort of sensor, (that is, if the sensor is for detecting temperature or smoke density and Ho is a reference height (2.5 m).) Thus, the relation for the relative output y with respect to the height H of the ceiling, according to an index $\beta$, is obtained.

In FIG. 9, 50H is an installation height setting section, which sets the installation heights of the respective analog sensors 1*a* to 1*n*, and provides the set installation heights to a second correction coefficient setting section 60H. The second correction coefficient setting section 60H sets inverse numbers of the relative values y of the outputs, obtained according to formula (4) above on the basis of the installation heights H provided from the installation height setting section 50H, as correction coefficients KH, in the correction calculating section 40. Of course, the correction coefficients KH may also be calculated preliminarily. In this case, a collation table between the installation heights H and the correction coefficients KH may be stored in the second correction coefficient setting section 60H, so that the relevant correction coefficient KH may be determined only by inputing the installation height, without calculating the correction coefficient at the correction coefficient setting section 60H.

Figure 12:
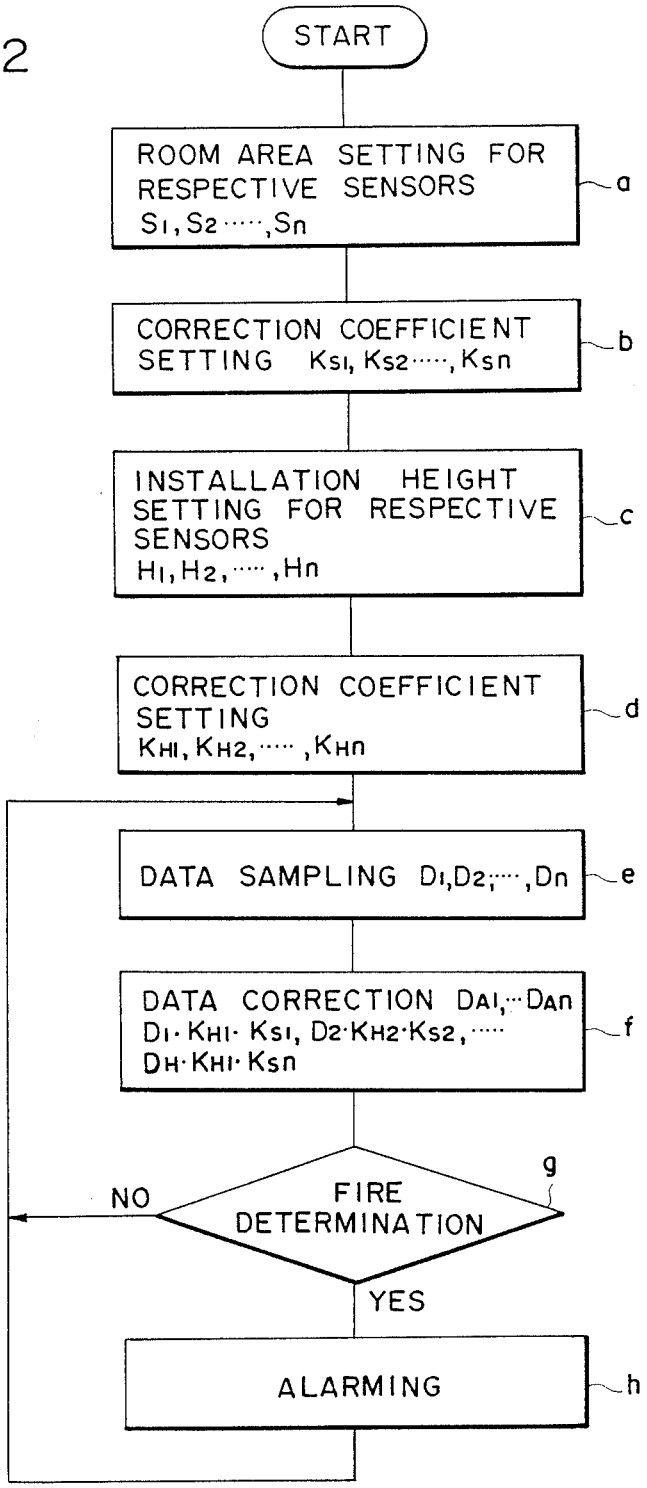
FIG. 12 is a flowchart showing an operation of the system illustrated in FIG. 9.

An operation of the embodiment as illustrated in FIG. 9 will now be described, referring to a flowchart of FIG. 12.

First, supervised room areas S1, S2 ... Sn of the respective analog sensors 1*a* to 1*n* are set at block a. After the setting of the room areas S1 to Sn at block a is complete, the step proceeds to block b to set correction coefficients KS1 to KSn for the corresponding room areas S1 to Sn, respectively. More particularly, the set room areas S1 to Sn are substituted in formulae (1) to (3) above, corresponding to the temperature, smoke density and CO gas concentration to be detected by the analog sensors 1a to 1n to obtain relative values RT, RS, and RG. Inverse numbers of the obtained relative values are set as correction coefficients KS1 to KSn, respectively.

Then, the installation heights H1, H2 ... Hn are set for the respective analog sensors 1*a* to 1*n* at block c.

After setting the installation heights H1 to Hn at block c, the next step proceeds to a succeeding block d to set correction coefficients KH1 to KHn corresponding to the installation heights H1 to Hn, respectively. More specifically, the previously set installation heights H1 to Hn are substituted in formula (4) to obtain relative values y for the respective analog sensors 1*a* to 1*n*. Correction coefficients KH1 to KHn are set in the form of inverse numbers of the relative values y.

After the setting operation of the correction coefficients KS1 to KSn and KH1 to KHn is complete, analog detection data obtained from the respective analog sensors 1*a* to 1*n* are sampled sequentially at predetermined periods at block e. The sampled data are converted into digital data by the A/D converter 3 to be supplied to the correction calculating circuit 40. The correction calculating circuit 40 multiplies the sensor data by the corresponding correction coefficients set at block b, d as indicated at block f.

Assuming that the actual detection data value is D, a correction value DA $=D \cdot KS \cdot KH$ is obtained by multiplying the data value D by the correction coefficients KS, obtained according to formulae (1) and (2) and the correction coefficient KH obtained according to formula (4).

Subsequently, fire determination is carried out at determining block g, through the functional approximation made by using the corrected sensor data, or through the comparison with a predetermined threshold value. When a fire has been detected the next step proceeds to block h to given an alarm.

Figure 13:
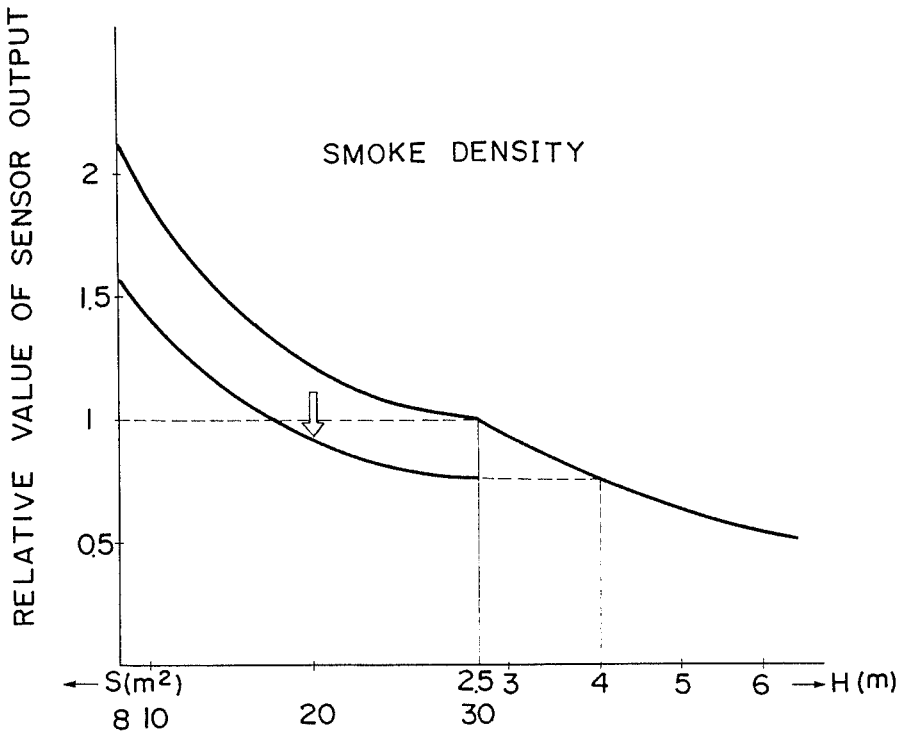
FIG. 13 is a graph showing a relationship, in the detection of smoke density, between the relative sensor output values when the room space is varied, and the relative sensor output values when the installation height is changed.

It is to be noted that there is a relationship shown in FIG. 13, between the relative value of the sensor output when the area of the room is varied and the relative value of the sensor output when the installation height is changed. FIG. 13 shows the relationship, in the detection of smoke density, between the relative value of the sensor output when the room area is varied and the relative value of the sensor output when the installation height is varied. The central axis of ordinates indicates the reference values of the respective relative values. The relative value of the sensor output, when the area S of the room is 30 $m^2$ and the installation height is 2.5 m, is set at 1. The light curve shows a change in the relative value of the sensor output when the area S of the room is fixed and the installation height H is varied. The left curve shows a change in the relative value of the sensor output when the installation height H is fixed and the area S of the room is varied. Therefore, if the installation height H is fixed at 4 m and the area S of the room is varied, then a curve is derived by multiplying the relative value 0.75, which is shown in FIG. 13, by to all of the component points of the original curve. Therefore, the correction value KS KH in the embodiment of FIG. 9 may be obtained in the form of an inverse number of one relative value of the sensor output obtained from FIG. 13, without calculating the two correction values KS and KH separeately. For this reason, the two correction coefficient setting sections 60S and 60H may be combined.

The functions of the respective sections of the foregoing embodiments may be realized in the form of a microcomputer hardware and a program combination.

Figure 14:
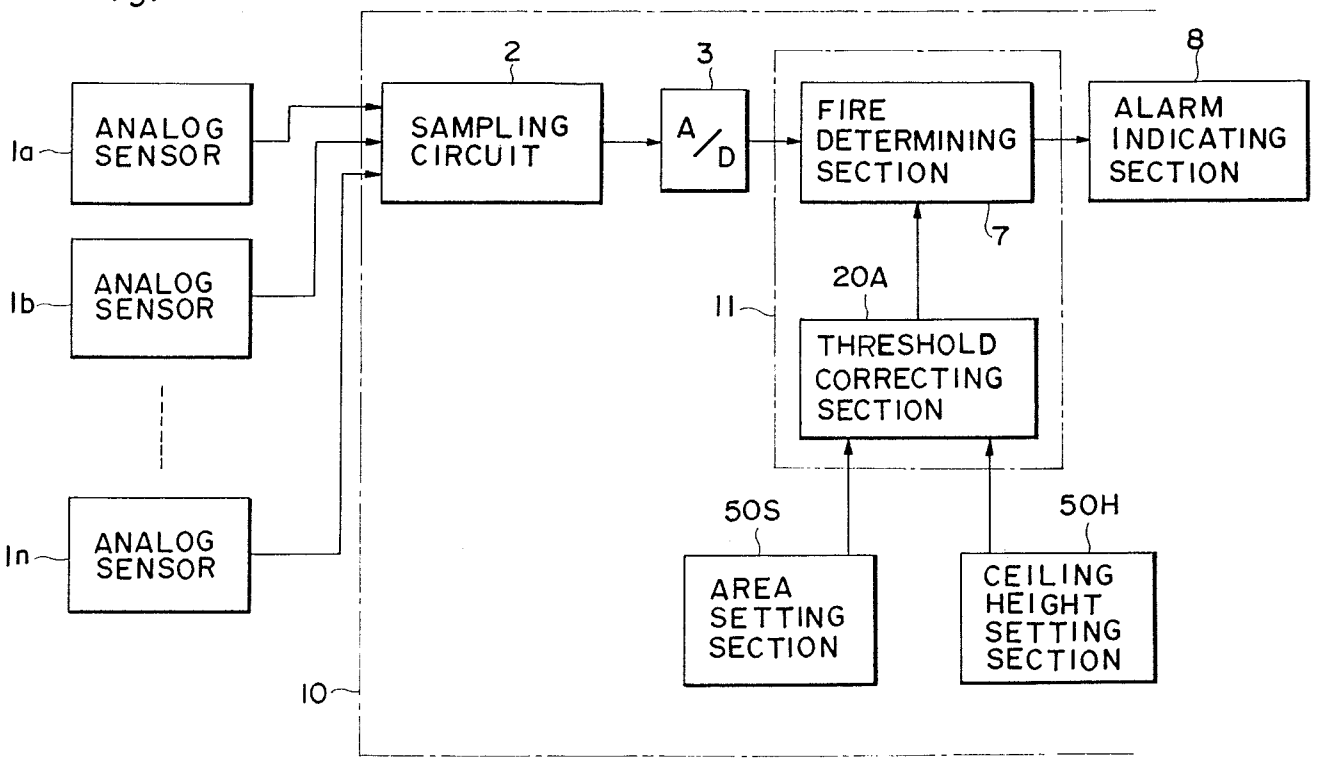
FIG. 14 is a block diagram of a further embodiment of the present invention.

FIG. 14 is a block diagram showing a further embodiment of the present invention, in which the threshold values used in the fire determining circuit are corrected by the areas of the rooms and the installation heights of the analog sensors. More particularly, the area setting section 50S and the ceiling height setting section 50H are connected to a threshold value correcting section 20A, which in turn is connected to the fire determining section 7.

The threshold value correction at the threshold value correcting section 20A is similar to that of the embodiment as illustrated in FIG. 8, with respect to the areas. With respect to the installation heights, the correction coefficients of the embodiment as shown in FIG. 9 are used.

The contents of the fire determination is similar to that of each of the foregoing embodiments and the description of the fire determination per se is not repeated here.

Figure 15:
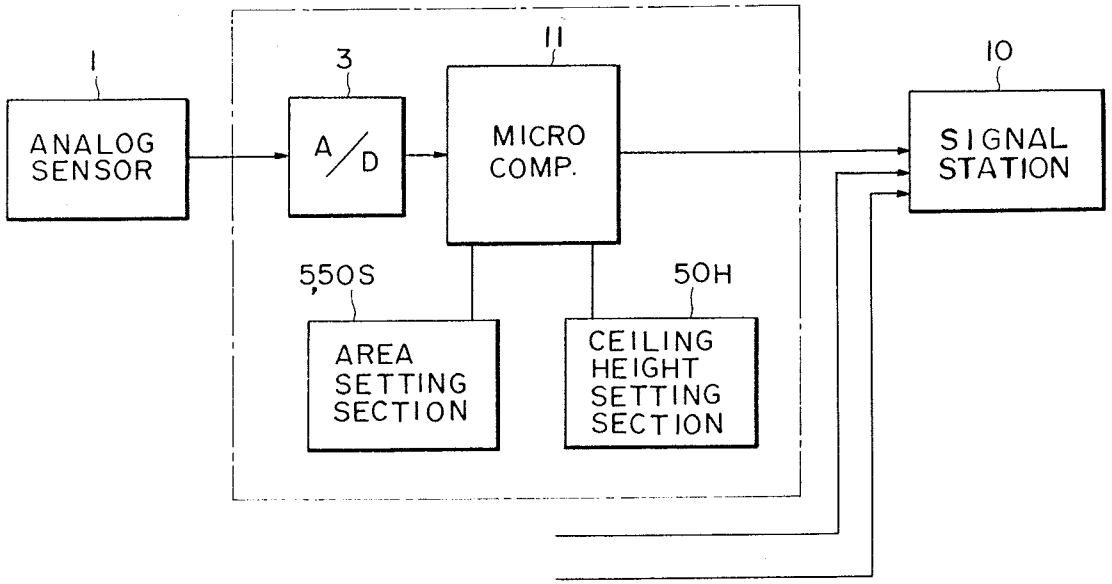
FIG. 15 is a block diagram of a still further embodiment of the present invention.

Although the fire determination is carried out after the detection data from the analog sensors have been corrected at the central signal station in the foregoing embodiments, the present invention is not limited to this way of fire determination and analog sensors per se may have a function of correcting the sensor data corresponding to the ara of the room. In this case, one analog sensor section 1, an A/D converter 3, a microcomputer 11, an area setting section 5, 50S, a ceiling height setting section 50H, etc. are connected to the central signal station as illustrated in FIG. 15.

We claim:

1. A fire alarm system comprising:

a plurality of analog sensors for detecting a change in ambient conditions caused by a fire;

a correcting means for providing correct data from the respective analog sensors on the basis of set supervisory regions for the respective analog sensors which are defined by walls, beams or inwardly extending projections surrounding the respective analog sensors; and a fire determining means for carrying out fire determination based on the correct data provided by said correcting means.

2. A fire alarm system according to claim 1, wherein said correct means determines the correcting data based on heights of the respective analog sensors from a floor as well as the volume of the supervisory regions.

3. A fire alarm system according to claim 2, wherein said correcting means comprises:

a first correction coefficient setting section or storing correction coefficients to be selected according to the supervisory regions set for the respective analog sensors and outputting the correction coefficient corresponding to the analog sensor being processed; said correction coefficients being variable and being storable variably by said setting section;

a second correction coefficient setting section for storing correction coefficients to be selected according to installation heights set for the respective analog sensors and outputting the correction coefficient corresponding to the analog sensor being processed; said correction coefficients to be selected according to the installation heights being variable and being storable variably by said second setting section; and a correction calculating section for calculating correct data from the first and the second correction coefficient outputs from the first and the second correction coefficient setting sections and input analog data.

4. A fire alarm system according to claim 3, wherein threshold values to be selected according to the supervisory regions and sensor installation heights each set for the respective analog sensors are insertable into said correcting means, said correcting means storing the threshold values and having an output for the threshold value corresponding to the analog sensor being processed.

5. A fire alarm system according to claim 1, wherein said correcting means comprises:

a correction coefficient setting section for receiving correction coefficients to be selected according to the supervisory regions set for the respective analog sensors, said setting section storing the correction coefficients and outputting the correction coefficient corresponding to the analog sensor being processed; said analog sensors receiving input analog data; said correction coefficients being variable and being storable variably by said setting section; and a correction calculating section for calculating correct data from the correction coefficient output from said correction coefficient setting section and the input analog data.

6. A fire alarm system according to claim 1, wherein said correcting means utilizes. as said correct data, threshold values for detection data from the respective analog sensors which are determined by the supervisory regions.

7. A fire alarm system according to claim 6, wherein threshold values to be selected according to the supervisory regions set for the respective analog sensors are insertable into said correcting means, said correcting means storing the threshold values and having an output for the threshold value corresponding to the analog sensor being processed said threshold values being variable and being storage variably by said correcting means.

8. A fire alarm sensor comprising:

an analog sensor section for detecting a change in ambient conditions caused by a fire;

a correcting section for providing correct data from the analog sensor section on the basis of a set supervisory region for the analog sensor section which is defined by walls, beam or inwardly extending projections surrounding the analog sensor section; and a fire determining section for carrying out fire determination based on the correct data provided by said correcting section.

9. A fire alarm sensor according to claim 8, wherein said correcting section determines said correct data based on height of the respective analog sensor from a floor.

10. A fire alarm sensor according to claim 9, wherein said correcting section comprises:

a first correction coefficient setting section for storing a correction coefficient to be selected according to the supervisory region set for the analog sensor section and outputting the correction coefficient; said correction coefficient being variable and being storable variably by said first setting section; a second correction coefficient setting section for storing a correction coefficient to be selected according to an installation height set for the analog sensor section and outputting the correction coefficient; said correction coefficient to be selected according to the installation height being variable and being storable variably by said second setting section, said analog sensor section receiving input analog data; and a correction calculating section for calculating correct data from a first and a second correction coefficient output from said first and the second correction coefficient setting section and input analog data from the analog sensor section.

11. A fire alarm sensor according to claim 10, wherein a threshold value to be selected according to the supervisory region and sensor installation height each set for the analog sensor section are insertable into said correcting section, said correcting section storing the threshold value and outputting the threshold value corresponding to the analog sensor being processed; said threshold value being variable and being storable variable by said correcting section.

12. A fire alarm sensor according to claim 8, wherein said correcting section comprises:

a correction coefficient setting section for receiving a correction coefficient to be selected according to the supervisory region, said setting section storing the correction coefficient and outputting the correction coefficient, said correction coefficient being variable and being storage variably by said setting section; said analog sensor section receiving input analog data; and a correction calculating section for calculating correct data from the correction coefficient output from said correction coefficient setting section and the input analog data from said analog sensor section.

13. A fire alarm sensor according to claim 8, wherein said correcting section utilizes, as said correct data, a threshold value for detection data from the analog sensor which is determined by the supervisory region.

14. A fire alarm sensor according to claim 13, wherein the threshold value to be selected according to the supervisory region set for the analog sensor section is insertable into said correcting section, said correcting section storing the threshold value and outputting the threshold value; said threshold value being variable and being storable variably by said correcting section.

15. A fire alarm method operative in a fire alarm system or in a fire alarm sensor adapted to detect a change in ambient conditions caused by a fire, through a plurality of analog sensors, or in a single fire detector, said method comprises steps of:

determining correct data for detection data from the respective analog sensors based on supervisory regions for the respective analog sensors which are defined by walls, beams or inwardly extending projections surrounding the respective analog sensors; and carrying out fire determination based on the correct data determined by said step of determining correct data.

16. A fire alarm method according to claim 15, wherein said correct data is determined based on heights of the respective analog sensors from a floor.

17. A fire alarm method according to claim 16, wherein said step of determining correct data comprises:

setting a first correct coefficient section for outputting correction coefficients to be selected according to the supervisory regions set for the respective analog sensors so as to correspond to the analog sensors being processed, respectively;

setting a second correction coefficient section for outputting correction coefficients to be selected according to installation heights set for the respective analog sensors so as to correspond to the analog sensors being processed, respectively; said analog sensors receiving input analog data; and calculating correct data from the correction coefficient and the input analog data.

18. A fire alarm method according to claim 17, wherein said step of determining correct data outputs threshold values to be selected based on installation heights of the respective analog sensors so as to correspond to the analog sensors being processed, respectively.

19. A fire alarm method according to claim 15, wherein said step of determining correct data comprises:

setting a correction coefficient section for outputting correction coefficients to be selected according to the supervisory regions set for the respective analog sensors so as to correspond them to the analog sensors being processed, respectively; said analog sensors receiving input analog data;

calculating correct data from the output correction coefficient and the input analog data.

20. A fire alarm method according to claim 15, wherein said step of determining correct data utilizes, as said correct data, threshold values for detection data from the respective analog sensors which are determined by the supervisory regions.

21. A fire alarm method according to claim 20, wherein said step of determining correct data outputs threshold values to be selected based on the supervisory regions for the respective analog sensors so as to correspond to the analog sensors being processed, respectively.

* * * * *